US005441086A

United States Patent [19]

Nänni

[11] Patent Number: 5,441,086

[45] Date of Patent: Aug. 15, 1995

[54] GRIPPER SHUTTLE FOR A LOOM

[75] Inventor: Daniel Nänni, Winterthur, Switzerland

[73] Assignee: Sulzer Ruti AG, Ruti, Switzerland

[21] Appl. No.: 178,700

[22] Filed: Jan. 10, 1994

[30] Foreign Application Priority Data

Feb. 18, 1993 [DE] Germany ..... 43 05 030.1

[51] Int. Cl.[6] ..... D03D 47/24

[52] U.S. Cl. ..... 139/196.2

[58] Field of Search ..... 139/196.2, 438, 448

[56] References Cited

U.S. PATENT DOCUMENTS 3,712,345 1/1973 Pfarrwaller ..... 139/196.2
3,853,152 12/1974 Pfarrwaller ..... 139/196.2
3,854,506 12/1974 Pfarrwaller ..... 139/196.2

FOREIGN PATENT DOCUMENTS 1379366 3/1988 U.S.S.R. ..... 139/196.2

*Primary Examiner*—Andrew M. Falik
*Attorney, Agent, or Firm*—Khourie and Crew Townsend and Townsend

[57] ABSTRACT

A gripper projectile for a loom includes a housing (1) made as a hollow body, a weft yarn clamp (2) which is arranged to fit into the housing and at least one connector element (4) which connects the housing (1) and the weft yarn clamp (2) together. The weft yarn clamp consists of a pair of clamp arms (5) prestressed with springy elasticity and a yoke (6) which connects the pair of clamp arms. An insert body (3) of elastic material is inserted between the clamp arms (5). The insert body (3) exhibits a sawtooth like profiling which is formed at its edge faces in such a way that the individual portions (12) of the profile rest with deformation against the insides of the clamp arms (5). The insert body can also be formed with rows of perforations which further enable its edges to deform against the insides of the clamp arms. The perforations can extend across or be parallel to the length of the clamp arms.

12 Claims, 2 Drawing Sheets

GRIPPER SHUTTLE FOR A LOOM

The present invention is concerned with a gripper shuttle.

More particularly, between clamp arms actuating the opposed jaws of the shuttle there is disclosed the insertion of elastic material. This inserted elastic material includes edges bearing on the clamp arms to avoid oscillations in the opposed jaws of the shuttle resulting in weft yarn loss from the shuttle.

BACKGROUND OF THE INVENTION

In the case of the known projectiles the weft yarn clamp on the yoke is connected rigidly to the housing by rivets or the weft yarn clamp is connected to the housing non-rigidly via a spring body arranged in the yoke. In the case of both executions insert bodies of elastic material are arranged between the arms of the clamp and/or between the weft yarn clamp and the housing.

By these measures the jerks which act upon the projectile during the weft yarn insertion process are transmitted to the weft yarn clamp damped and consequently the excitation of oscillation is moderated. Although the frequency of loss of the yarn is thereby reduced, the oscillations occurring as before impair the function of the weft yarn clamp because the bouncing together and/or chafing of the clamp cheeks caused by the oscillations still occur.

SUMMARY OF THE INVENTION

A gripper projectile for a loom is set forth which prevents oscillations from being transmitted to its yarn clamp through jolts and jerks acting upon the projectile during weft insertion. These oscillations are dampened from transmission by a gripper projectile construction which includes a housing (1) made as a hollow body, a weft yarn clamp (2) which is arranged to fit into the housing and at least one connector element (4) which connects the housing (1) and the weft yarn clamp (2) together. The weft yarn clamp consists of a pair of clamp arms (5) prestressed with springy elasticity and a yoke (6) which connects the pair of clamp arms. An insert body (3) of elastic material is inserted between the clamp arms (5). The insert body (3) exhibits a sawtooth like profiling which is formed at the edge faces in such a way that the individual portions (12) of the profile rest with deformation against the insides of the clamp arms (5). Perforations are disclosed formed of rows of perforations in such a way that the edge faces rest with deformation of the penetrations against the insides of the clamp arms (5). The perforations can extend across or parallel to the length of the clamp arms.

Here the invention intends to create a remedy. The invention solves the problem of the oscillations generated during the weft yarn insertion process through the jolts and jerks which occur on the weft yarn. These oscillations are largely avoided by the insert body resting via the sawtoothlike profiling on the arms of the weft yarn clamp and/or penetrations into the insert body on the one hand and by the connector elements on the other.

The advantages which may be achieved by the invention are essentially to be seen in the improved connector elements. These connector elements may be ejected by a suitable tool. The connector elements have a short longitudinal extent in order to consequently prevent damage of the plastic insert. Further, setting of the clamping gap and of the clamping force of the yearn clamp is possible over a wide range. Through the inventive profiled construction of the insert body, a greater range of tolerance thereby of setting the gap and force become possible.

BRIEF DESCRIPTION OF THE DRAWINGS

In order to take better into account the alteration in the distance between the arms of the clamp caused during this setting, it may be of advantage if the profiling exhibits a tooth height which decreases continuously to the free end of the insert body.

The invention is explained below with the aid of the attached drawing. There is shown in.

DESCRIPTION OF THE PREFERRED EMBODIMENTS

Figure 1:
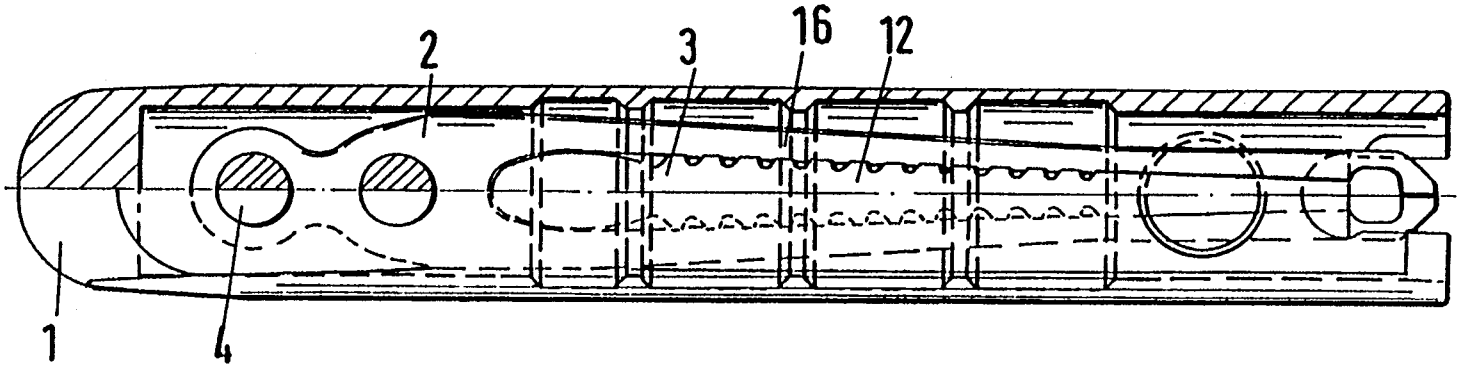
FIG. 1 illustrates a preferred embodiment of a gripper projectile in accordance with the invention, represented in partial section.
Figure 2:
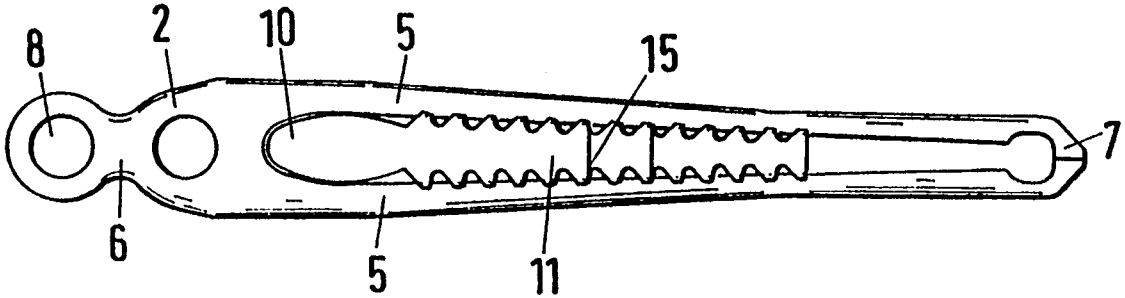
FIG. 2 illustrates a view of a weft yarn clamp and an insert body before the latter has been inserted.

The gripper projectile comprises a housing 1 which is made as a hollow body, a weft yarn clamp 2 which is arranged in the housing, an insert body 3 and two connector elements 4 which connect the housing to the weft yarn clamp.

The weft yarn clamp 2 consists of a pair of prestressed elastic clamp arms 5 and a yoke 6 connecting them. At the free ends of the arms 5 are formed portions 7 directed respectively inwards, which form clamp cheeks for a weft yarn.

The weft yarn clamp 2 arranged in the housing 1 is fastened to the housing 1 by means of two members 4 like pins. For doing this drilled holes 8 are provided which pass through the side walls of the housing 1 and the yoke 6 of the weft yarn clamp 2 respectively.

The members 4 have a circular cross-section and consist of fiber-reinforced plastics, e.g., carbon-fiber-reinforced polyetheretherketone (PEEK) or rectified plastics. The fiber-reinforcement is aligned in the direction axial to the member 4, whereby expansion of the member in the axial direction is prevented. The drilled holes passing through and the member are so designed that the latter is connected to the housing 1 and the weft yarn clamp 2 with a press fit and at its endfaces is essentially flush with the surfaces of the housing 1. The fiber reinforcement can be chosen from the group including carbon, metal, cotton, linen, etc.

The connection so designed may be released again by the member being driven out by means of a suitable tool.

The insert body 3 has a contour which is adapted essentially to the space existing between the arms of the clamp. The insert body 3 has a first portion 10 which fits into the fork between the elastic clamp arms 5 of the weft yarn clamp 2, and adjoining the first portion a second portion 11 which, starting from the first portion 10, tapers in towards the free end. The insert body 3 consists of an elastically yielding material, e.g., of polyurethane.

The insert body 3 is arranged between the arms of the clamp in such a way that starting from the fork it extends over a predetermined length of the arms. At opposite edge faces the insert body 3 exhibits a sawtooth-like profiling. The profiled portions have the same tooth height and are directed the same way and formed in the direction transverse to the edge faces.

Shoulders 15 rest against recesses 16 in the housing in order, e.g., to prevent longitudinal shifting of the insert.

Figure 3:
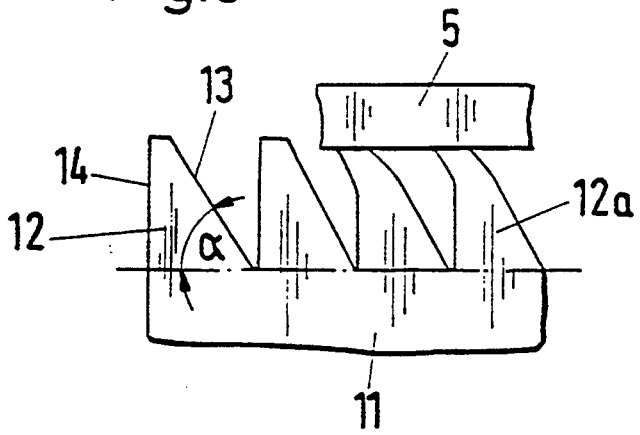
FIG. 3 illustrates a view of the profiled portion on a larger scale.

In FIG. 3 are shown the profiled portions formed on the insert body 3. The profiled portions 12 have an asymmetrical trapezoidal shape with one rising flank 13 and one steeply falling flank 14. It proves advantageous if the angle of rise a lies in the range from 30° to 60°. Besides this preferred embodiment the profile portion 12 may exhibit an asymmetrial triangular shape.

The insert body 3 has a width which is greater than the distance between the arms of the clamp, so that the profiled portions rest with deformation against the inner faces of the arms of the clamp (FIG. 3). The deformation leads to bending of the free ends of the profiled portions 12*a*, so that besides the damping which may be achieved through the inner friction a spring action is achieved.

The deformation occurs essentially at the profiled portion. A good contact is thereby guaranteed in an advantageous way between the insert body and the arms of the clamp even in the case of greater tolerances in production, and consequently a good positive connection is achieved between the insert body 3 and the arms of the clamp.

Figure 4:
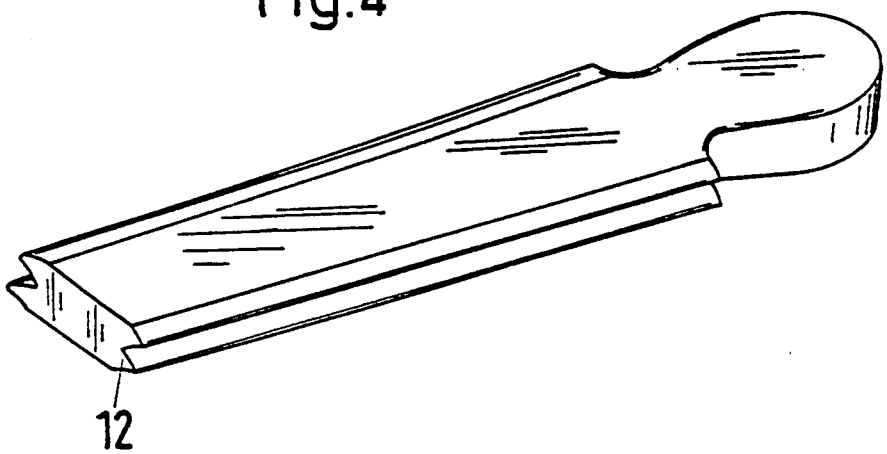
FIG. 4 illustrates a perspective of another embodiment of an insert body in accordance with the invention.

In the case of the embodiment shown in FIG. 4 the profiled portions 12 are made in the direction longitudinal to the edge faces, e.g., two profiled portions being provided on the edge faces.

Figure 5:
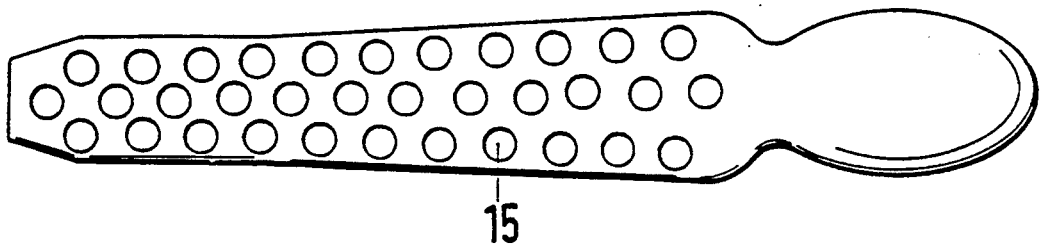
FIG. 5 illustrates a view of a further embodiment of an insert body in accordance with the invention.

FIG. 5 showns an insert body 3 which is provided with a perforation which is formed of three rows of holes 15 passing through, the said holes 15 being arranged at intervals.

What is claimed is:

1. A gripper projectile for a loom, having:

a housing made as a hollow body, a weft yarn clamp which is arranged in the housing and includes a pair of clamp arms extending in a longitudinal direction prestressed with elasticity towards one another through a yoke which connects the clamp arms;

an insert body of elastic material inserted between the clamp arms and confronting the clamp arms at [an]inside edge faces thereof, and at least one connector element which connects the housing and the weft yarn clamp together, the improvement to the insert body including:

the insert body of elastic material has individual sawteeth forming a sawtooth like profile at the inside edge faces confronting the clamp arms;

the sawtooth like profile resting with the individual sawteeth having deformation against the inside edge faces of the clamp arms.

2. A gripper projectile for a loom according to claim 1 and wherein:

the sawtooth like profile is arranged across the longitudinal direction of the clamp arms.

3. A gripper projectile for a loom according to claim 1 and wherein:

the sawtooth like profile is arranged in the longitudinal direction of the clamp arms.

4. A gripper projectile for a loom according to claim 1 and wherein:

the insert body consists of an elastomer.

5. A gripper projectile for a loom according to claim 1 and wherein:

the insert body exhibits a profile with a saw tooth height which decreases continuously towards the weft yarn clamp.

6. A gripper projectile for a loom according to claim 1 and wherein:

the connector element is a pin which consists of plastics reinforced with reinforcing fibers.

7. A gripper projectile for a loom according to claim 6 and wherein:

the fiber reinforcement runs in the direction axial to the connector element.

8. A gripper projectile for a loom according to claim 6 and wherein:

the fiber reinforcement consists of fibers chosen from the group consisting of carbon, metal, cotton, and linen.

9. A gripper projectile for a loom according to claim 6 and wherein:

the connector element consists of polyetheretherketone.

10. A gripper projectile for a loom, comprising:

a housing made as a hollow body;

a weft yarn clamp which is arranged in the housing and includes a pair of clamp arms extending in a longitudinal direction prestressed with elasticity towards one another through a yoke which connects the clamp arms;

an insert body of elastic material inserted between the clamp arms and confronting the clamp arms at [an]inside edge faces thereof;

at least one connector element which connects the housing and the weft yarn clamp together;

the insert body of elastic material has individual sawteeth forming a sawtooth like profile at the inside edge faces confronting the clamp arms;

the sawtooth like profile resting with the individual sawteeth having deformation against the inside edge faces of the clamp arms; and, the connector element is a pin which consists of plastics reinforced with reinforcing fibers.

11. A gripper projectile for a loom according to claim 6 and wherein:

the fiber reinforcement runs in the direction axial to the connector element.

12. A gripper projectile for a loom according to claim 6 and wherein:

the connector element consists of polyetheretherketone.

* * * * *